US008851233B2

(12) United States Patent
Murphy

(10) Patent No.: US 8,851,233 B2
(45) Date of Patent: Oct. 7, 2014

(54) EMERGENCY ESCAPE LADDER

(76) Inventor: Russell Edward Murphy, Mitcham (AU)

( * ) Notice: Subject to any disclaimer, the term of this patent is extended or adjusted under 35 U.S.C. 154(b) by 9 days.

(21) Appl. No.: 13/258,123

(22) PCT Filed: Mar. 24, 2010

(86) PCT No.: PCT/AU2010/000352

§ 371 (c)(1),
(2), (4) Date: Sep. 21, 2011

(87) PCT Pub. No.: WO2010/108230

PCT Pub. Date: Sep. 30, 2010

(65) Prior Publication Data

US 2012/0012423 A1 Jan. 19, 2012

(30) Foreign Application Priority Data

Mar. 25, 2009 (AU) ..... 2009901260
May 27, 2009 (AU) ..... 2009902419

(51) Int. Cl.
*E06C 9/08* (2006.01)
*E06C 1/383* (2006.01)
*E06C 7/08* (2006.01)

(52) U.S. Cl.
CPC ..... *E06C 9/085* (2013.01); *E06C 7/086* (2013.01); *E06C 1/383* (2013.01)
USPC ..... 182/96; 182/160

(58) Field of Classification Search
USPC ..... 182/96, 160, 159
See application file for complete search history.

(56) References Cited

U.S. PATENT DOCUMENTS

| | | | | | |
|---|---|---|---|---|---|
| 256,990 | A | | 4/1882 | Fish | |
| 258,186 | A | * | 5/1882 | Winters | 182/18 |
| 314,899 | A | * | 3/1885 | Wilson | 182/160 |
| 779,463 | A | * | 1/1905 | Bras | 182/96 |
| 2,962,113 | A | * | 11/1960 | Heimlicher et al. | 182/230 |
| 3,025,923 | A | * | 3/1962 | Burnstein | 182/96 |
| 3,414,081 | A | * | 12/1968 | Wedvik | 182/160 |
| 3,439,776 | A | * | 4/1969 | Scheerer | 182/160 |
| 3,822,881 | A | * | 7/1974 | Douglass et al. | 472/110 |
| 4,189,028 | A | | 2/1980 | Reinhard | |
| 4,425,983 | A | * | 1/1984 | Reinhard | 182/96 |
| 4,463,829 | A | * | 8/1984 | Grin | 182/160 |
| 4,678,060 | A | * | 7/1987 | Pugliese | 182/160 |

FOREIGN PATENT DOCUMENTS

| | | | |
|---|---|---|---|
| FR | 2314656 | A * | 2/1977 |
| GB | 2363156 | B | 8/2002 |
| WO | 2002/066777 | A1 | 8/2002 |

* cited by examiner

*Primary Examiner* — Alvin Chin-Shue
(74) *Attorney, Agent, or Firm* — Richard M. Goldberg

(57) ABSTRACT

A folding emergency escape ladder for a dwelling includes a fixed vertical riser for fitting to the external wall of a dwelling, spaced apart, retractable rails pivoted thereto from a first end to function as rungs of the ladder and a movable vertical riser fitted in correspondingly from a second end of the rails such that the ladder is moveable between a retracted state with the rails folded up into the fixed and retracted vertical risers and an expanded, deployed state with the rails and risers functioning as a ladder mounted to the wall, one or more rails including an elongate rail rung terminating at the first and second ends in a rung head including an integral pivot and a projecting lobe extending radially from the pivot, the lobe including a buffer foot abutting a portion of the vertical risers coincident with the deployed state to buffer deployment of the ladder.

10 Claims, 15 Drawing Sheets

EMERGENCY ESCAPE LADDER

CROSS-REFERENCE TO RELATED APPLICATIONS

The present application claims priority from the content of which is incorporated herein by reference.

INTRODUCTION TO THE INVENTION

This invention relates to emergency escape ladders and the like positioned on the exterior of dwellings and in particular, to a collapsible fire escape ladder for positioning on multiple-storey dwellings which can be kept in a folded, unobtrusive and discrete state and readily available for immediate use during an emergency by expansion into a functional ladder allowing escape from a multi-storey dwelling.

BACKGROUND TO THE INVENTION

Fire escape facilities in multi-level dwellings, particularly multi-tenanted dwellings and commercial constructions have regulatory requirements for the provision of fire escape access built into the building codes.

In contrast to such building codes, domestic housing and in particular, commonly constructed two-storey domestic housing, does not have such a requirement and emergency escape from the upper stories during fire and other emergencies, is not provided for by way of an integral or inbuilt escape ladder or stairwell on the exterior of the building. When required, such upper level escapes are assisted by way of emergency services attending such buildings during fire or other emergencies.

Whilst the attendance of emergency services to such emergency situations can often provide exterior access by way of vehicle mounted ladders and the like, the provision of built-in emergency ladders to two-storey buildings and the like, would greatly aid emergency services in evacuating trapped occupants and moreover, a discrete and reliable emergency ladder system built in to two-storey dwellings would provide occupants with the option of escaping from a second-storey building without relying on emergency services personnel and remotely provided equipment.

Accordingly, one object of the invention is to provide a discrete and functional emergency escape ladder, particularly adapted for fitting to a two-storey domestic dwelling so as to provide a readily available escape route during times of emergency evacuations.

SUMMARY OF THE INVENTION

In a first aspect the invention provides a folding emergency escape ladder for a dwelling comprising a fixed vertical riser adapted for fitting to the external wall of a dwelling, a plurality of retractable rails pivoted thereto from a first end and spaced at a distance apart suitable to function as rungs of said ladder and a movable vertical riser fitted in a corresponding manner from a second end of said rails such that said ladder can be moved between a retracted state with said rails folded up into said fixed and retracted vertical risers and an expanded or deployed state with said rails and risers functioning as a ladder mounted to said wall wherein one or more of said rails include an elongate rail rung terminating at said first and second ends in a rung head, said rung head including an integral pivot means and a projecting lobe extending radially from said pivot point wherein said lobe includes a buffer foot adapted to abut a portion of said vertical risers coincident with said deployed state to buffer the deployment of said ladder.

In another aspect the invention provides a folding access ladder for a dwelling comprising a fixed vertical riser adapted for fitting to the external wall of a dwelling, a plurality of retractable rails pivoted thereto from a first end and spaced at a distance apart suitable to function as rungs of said ladder and a movable vertical riser fitted in a corresponding manner from a second end of said rails such that said ladder can be moved between a retracted state with said rails folded up into said fixed and retracted vertical risers and an expanded or deployed state with said rails and risers functioning as a ladder mounted to said wall wherein one or more of said rails include an elongate rail rung terminating at said first and second ends in a rung head, said rung head including an integral pivot means and a projecting lobe extending radially from said pivot point wherein said lobe includes a buffer foot adapted to abut a portion of said vertical risers coincident with said deployed state to buffer the deployment of said ladder, and wherein said ladder includes a lock adapted to prevent or allow deployment of said ladder, said lock comprising a radial lock tab formed in said rung head and a radial lock adapted to cooperate with said radial lock tab to lock said rung head in a position corresponding with the retracted position of said ladder.

The rung head preferably includes a latch means adapted to cooperate with a keeper for holding the rails and movable vertical riser in the retracted state.

The keeper is most preferably fitted to the fixed riser and adapted to cooperate with the rung head, fitted to the second end of the rail or rails in question.

The keeper is preferably movable between a first engaging position and a second releasing position and is bias to said first position, receive and engage latch means and movable against its inherent bias to the second position, so as to release the latch means. The bias is provided most preferably by a spring action of keeper material, with the keeper being drawn down against the side of fixed vertical riser around a lug or other retaining means.

The ladder preferably includes a release means, taking the form of a release cable, adapted to cooperate with the keeper, wherein the release means includes a primary release cable fitted to the keeper and adapted to move the keeper against its bias by drawing the keeper around the keeper to the lug, against its inherent bias or spring action, so as to draw the keeper from the first engaging position to its second release position and wherein the primary release cable is appropriately conduited through the vertical riser to the interior of the dwelling.

The ladder may also include a secondary release cable fitted to the keeper in a manner as previously described where the secondary release cable is conduited through the fixed vertical riser and operated from the exterior of the dwelling and most preferably from a lower ground position, near the base of the vertical riser by way of an override release lever, positioned within reach from the ground.

In addition to the above features, the ladder preferably includes an alarm system or means to activate an alarm once the ladder is deployed so as to provide an audible and/or visual alert to the deployment of the ladder and the associated potential threat and emergency of an urgent escape from the dwelling in question.

The ladder may be configured to include the positioning of the fixed and movable vertical risers, being positioned against an external wall with the positioning most preferably including a spacer, so as to position the ladder against the exterior wall of the dwelling, the space therefrom so as to facilitate the safe purchase of an escaping individual to the rungs and general ladder configuration and minimise any potential for accidents during the escape.

In an alternative embodiment, the ladder of the invention may be positioned with the fixed vertical riser positioned against the wall or positioned against the wall with a spacer, and the movable vertical riser being positioned for movement away from the wall, such that the ladder is employed at 90 degrees to the wall, so as to provide an alternative configuration. The 90 degree configuration may preferably include a plurality of triangulated stabilisers, pivotally fitted between the fixed and movable risers so as to assist with the stabilising of the deployed ladder at 90 degrees away from the wall.

LEGEND

1. Wall
2. Fixed vertical riser
3. Upper transverse bracket
4. Lower transverse bracket
5. Movable vertical riser
6. Rung
7. First end
8. Second end
9. Locating notch
10. Release mechanism
11. Release knob
12. Primary release cable
13. Rung head
14. Radial lobe
15. Buffer foot
16. Catch
17. Latch means
18. Keeper
19. Radial lock tab
20. Override release lever
21. Rung pivot
22. Back-up release cable
23. Mounting anchor/spacer
24. Radial lock
25. Stabilizer
26. Strut
27. Keeper pivot lug
28. Spigot

DETAILED DESCRIPTION

Figure 1:
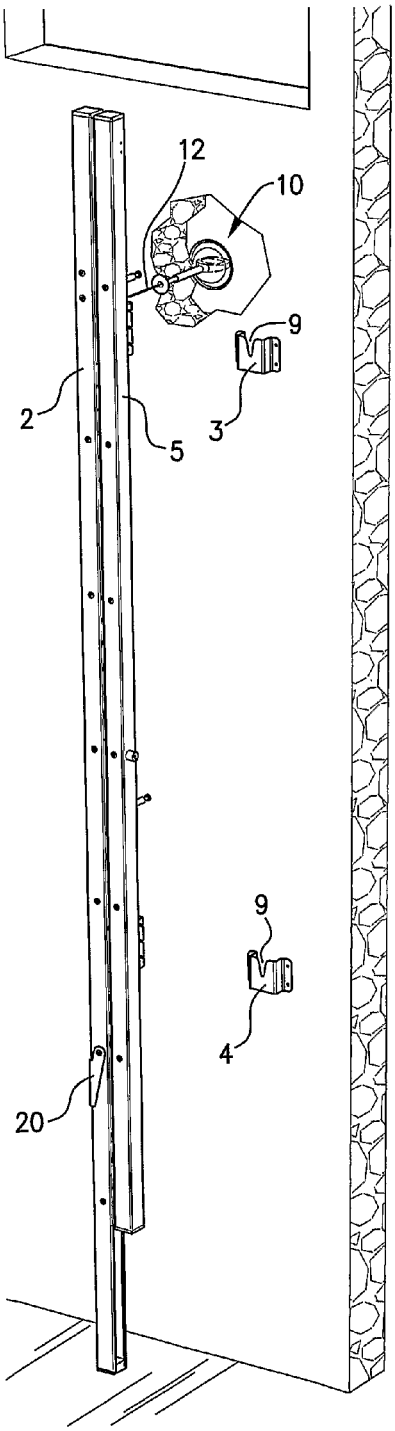
FIG. 1 shows a closed escape ladder spaced against a wall

The invention will now be described with reference to one particularly preferred embodiment as shown in FIGS. 1 through to 18, and the accompanying legend.

Referring firstly to FIGS. 1 to 11, the invention is shown detailing the emergency fire escape ladder in its folded or retracted form, attached to the external wall of a dwelling 1 mounted for parallel alignment to the wall. The escape ladder comprises a fixed vertical riser 2 fitted to the wall of the dwelling 1, either directly or most preferably via an upper transverse mounting bracket 3 and a lower transverse mounting bracket 4, which in turn are fixed directly to the exterior wall of a dwelling 1. The mounting brackets provide a spacer which allows the ladder rungs to be sufficiently removed from the wall to provide safe purchase by the user during escape. The escape ladder further comprises a second vertical riser in the form of a moveable vertical riser 5 which is connected to the fixed vertical riser by a plurality of rails as detailed in the figures with the rails 6 being hinged respectively to the fixed and moveable, vertical risers. The hinged rails are each pivoted at a first end 7 to the fixed vertical riser at a suitable spaced distance, commensurate with the function as rungs of the ladder. The second end 8 of the rails 6 is pivotally attached in a corresponding manner to the moveable, vertical riser 5 such that the ladder can be readily moved between a retracted state as shown in FIG. 1, where the moveable, vertical riser is pivoted up by cooperation with the plurality of rails 6 into contiguous abutment with the fixed vertical riser 2, and an expanded state shown in FIGS. 2 and 4 where the movable, vertical riser is lowered down so as to expose the rails 6, or deployed such that when the moveable, vertical riser is fully lowered down, the rails are presented in a horizontal fashion so as to function as rungs of the escape ladder.

In order to ease the mounting and function of the folding emergency fire escape ladder of the invention, the ladder can be provided with mounting brackets 3 and 4 such that the fitting of the ladder to a dwelling only requires the fitting of the mounting brackets to the wall of a dwelling 1, and once fitted, the ladder is fully operational as shown in the figures.

The upper and lower transverse mounting brackets can preferably function as additional stabilising elements to receive the moveable, vertical riser in the second expanded position such that it locks or clicks into a fixed position via the locating notch 9, when the rails adopt the horizontal orientation. In addition, the locking of the moveable, vertical riser provides additional stability and safety for the ladder, and ensures that it is not capable of collapse under the weight of an occupant.

The upper and lower transverse brackets preferably position the fixed and moveable vertical risers in conjunction with the rungs 6 such that the rungs are positioned at approximately 140 mm distance out from the wall, so as to allow safe and ready use of the ladder with sufficient room to allow grip of the rungs by the user's hands and feet.

Referring to FIGS. 3 to 6 the upper and lower brackets most preferably include a dedicated locating notch 9 formed therein, adapted to receive spigots 28 associated with the moveable, vertical riser so as to ensure when the ladder is in the locked position, the spigots 28 snugly engage the notches 9 so as to ensure security of the ladder in a vertical as well as a horizontal orientation such that the ladder has no tendency to move backward or forward relative to the wall, so as to provide comfort and security to the users during an escape.

As an alternative fixing of the ladder to the wall, the upper and lower transverse brackets can be made up as a two component bracketing system with the fixed vertical riser 2 being fitted to the wall by way of a dedicated spacer and mounting anchor 23. The mounting anchor provides a means of fixing the fixed riser 2 to the wall at a suitable spaced distance and the separate upper and lower transverse brackets 3 and 4 are positioned at a suitable distance away on the wall so as to receive the movable vertical riser 5 as it is deployed.

Figure 2:
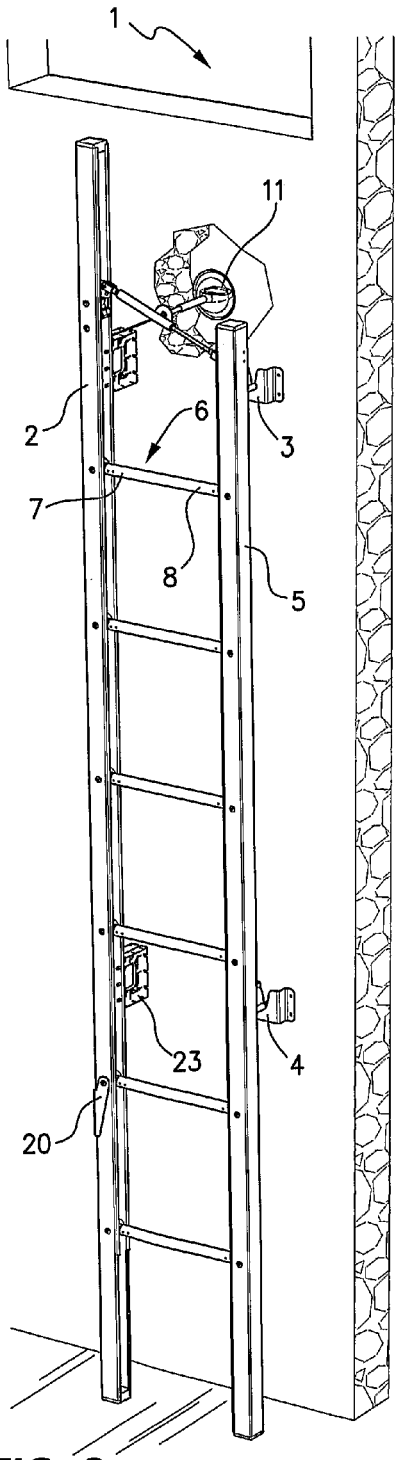
FIG. 2 shows an open ladder spaced against a wall
Figure 3:
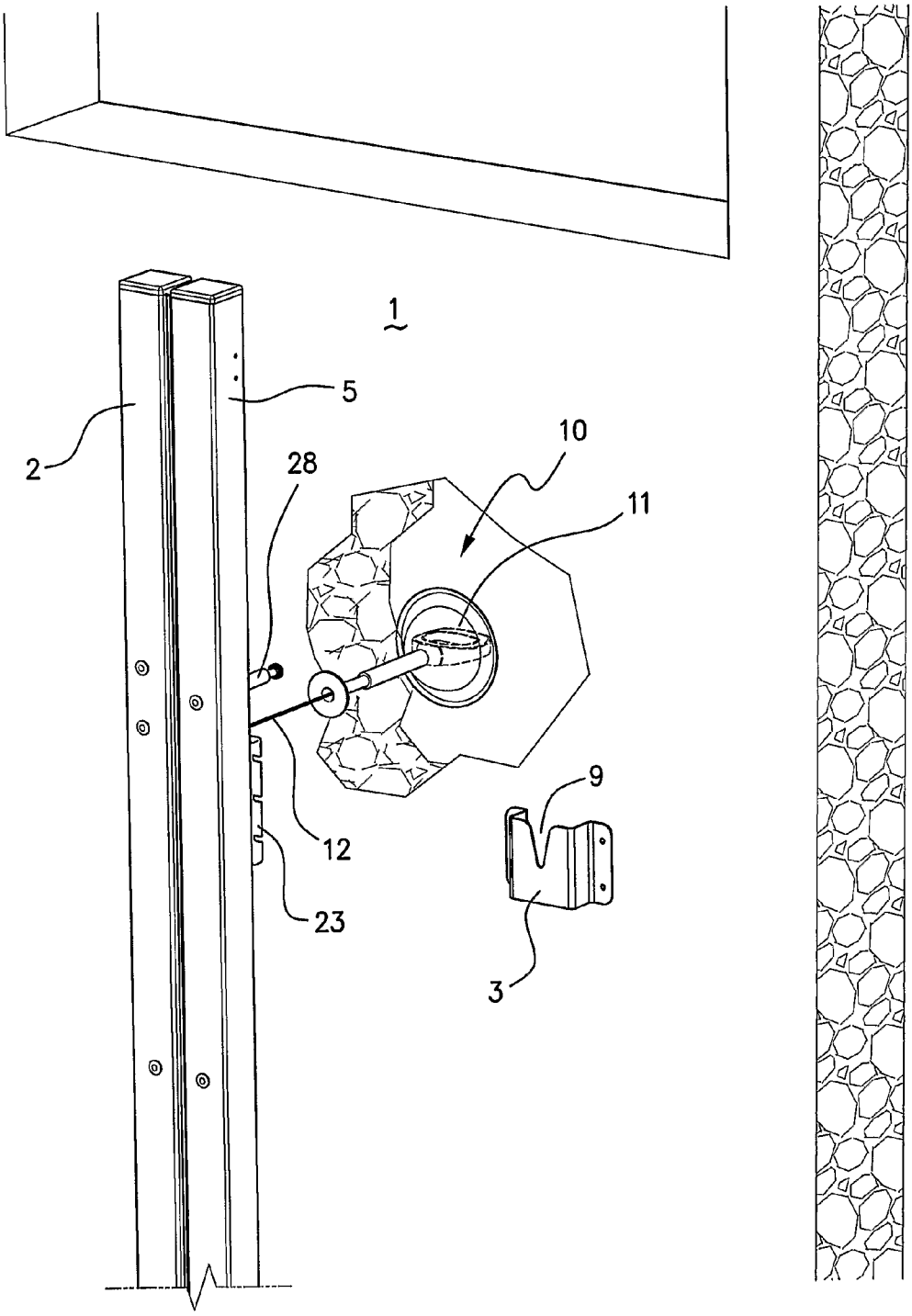
FIG. 3 shows a closed view in detail
Figure 4:
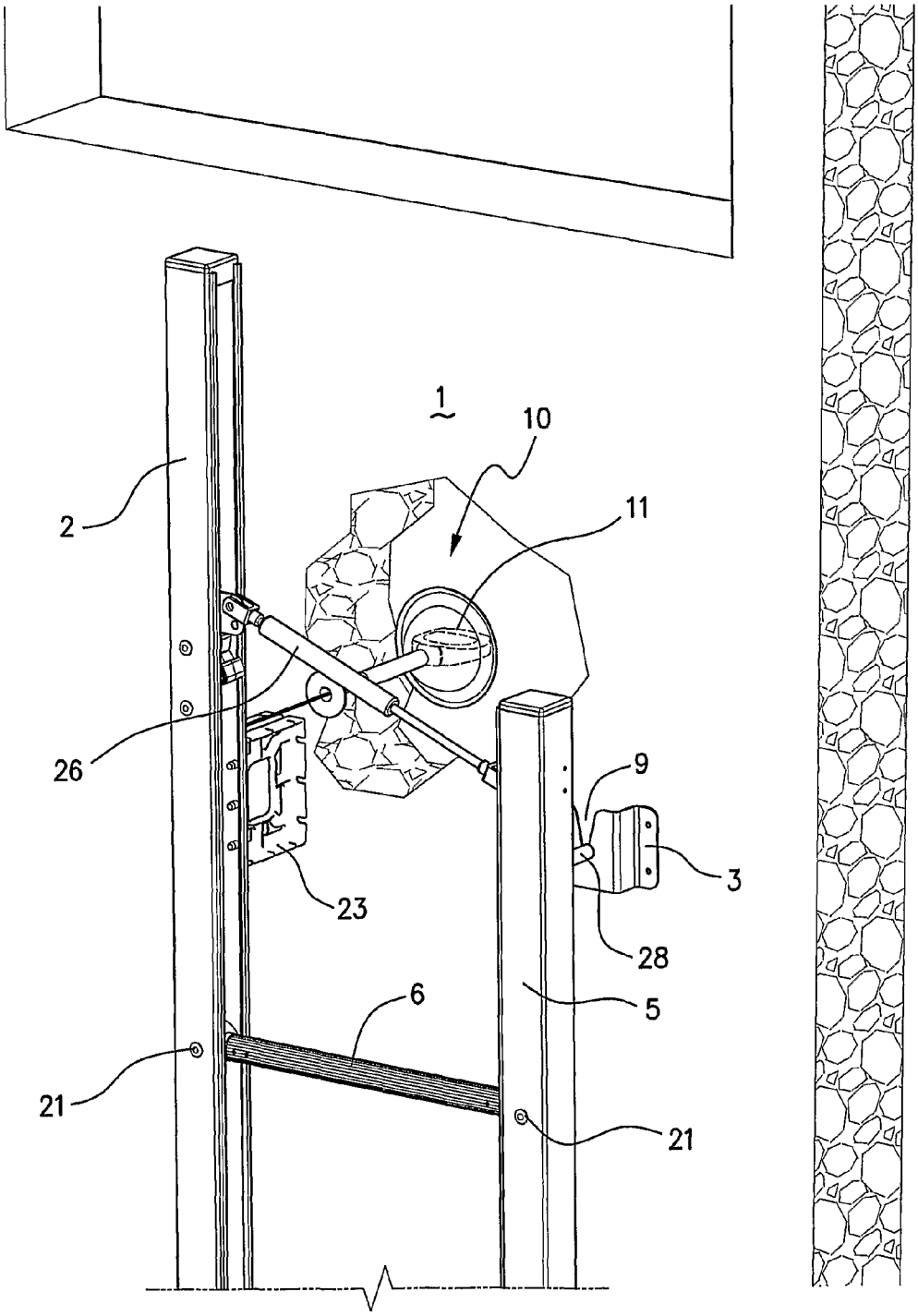
FIG. 4 shows an open view in detail

The folding emergency fire escape ladder of the invention is preferably biased toward the deployed position as shown in FIGS. 2 and 4, and when in use or when required for use, can be simply and readily moved from the retracted position as shown in FIGS. 1 and 3, to the expanded or deployed position with the moveable, vertical riser acting with the bias and being drawn down and locked into place as shown in FIGS. 2 and 4 by engagement with the upper and lower transverse mounting brackets.

The compact nature of the invention is further provided by the provision of the rails 6, being pivotally attached and moveable within the confines of the fixed and vertical risers, where the fixed and vertical risers can be provided as a U-shaped channel such that movement of the vertical riser with the fixed and moveable risers being folded up in the retracted position, allows the rails to be fully contained within the interior of the channel section of the respective fixed and moveable vertical risers.

Referring now to FIG. 4, the deployment of the emergency escape ladder is most preferably controlled with the assistance of a gas strut 26, positioned between the fixed vertical riser 2 and the moving vertical riser 5, such that the speed of deployment and return of the ladder to the retracted or closed state can be controlled.

Figure 5:
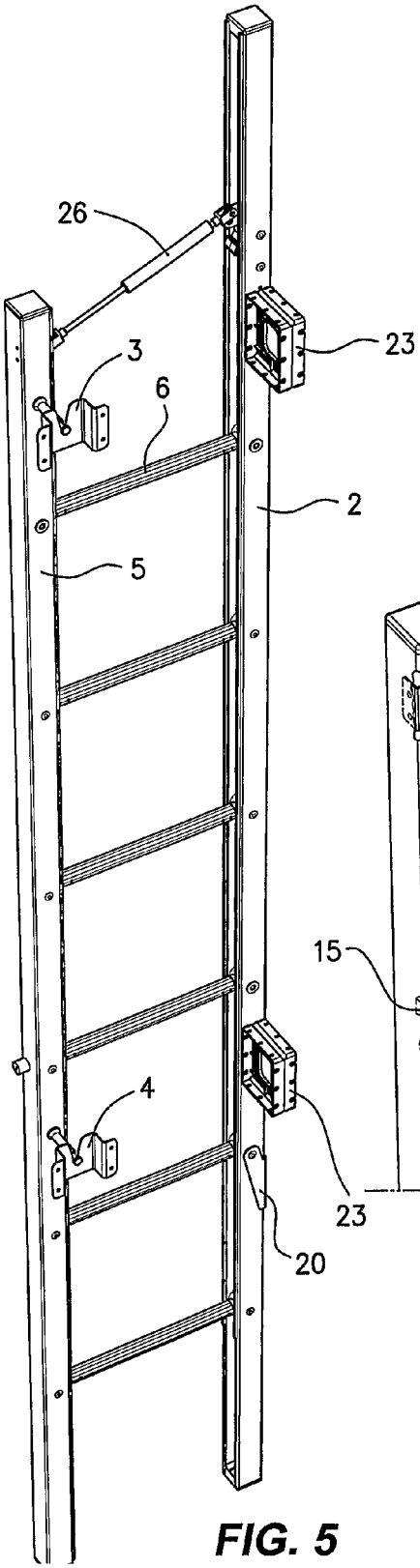
FIG. 5 shows an open view from rear spaced against a wall
Figure 6:
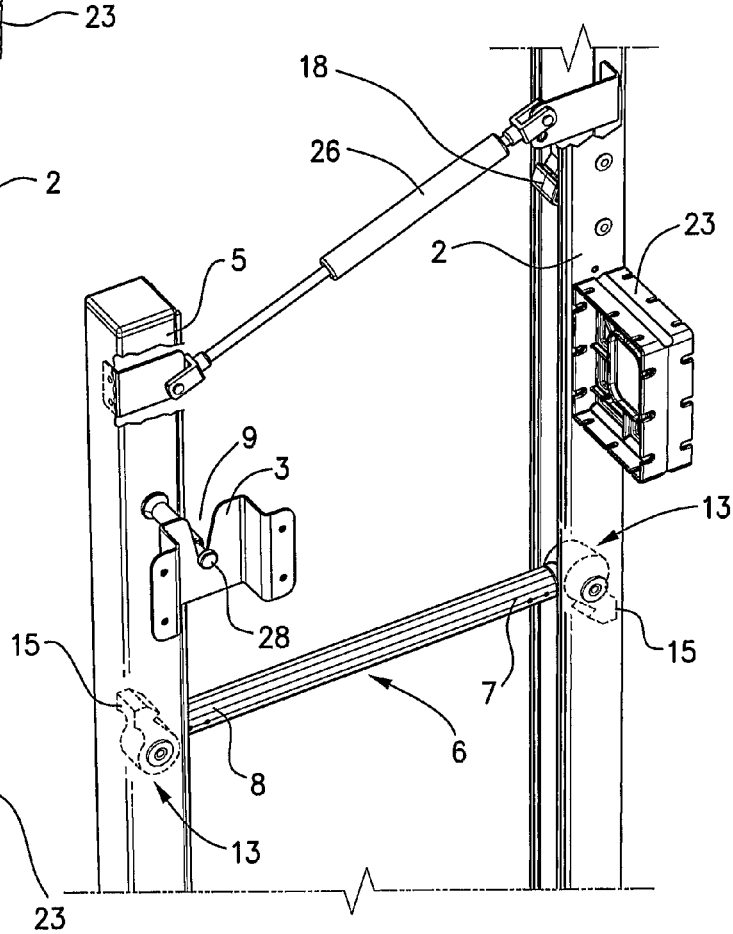
FIG. 6 shows an open view in detail

FIGS. 5 and 6 show a reverse perspective of the ladder in the retracted and deployed position with a clear reference to the positioning and make-up of the upper and lower transverse brackets and the spacing provided between the mounted ladder and the wall.

Figure 7:
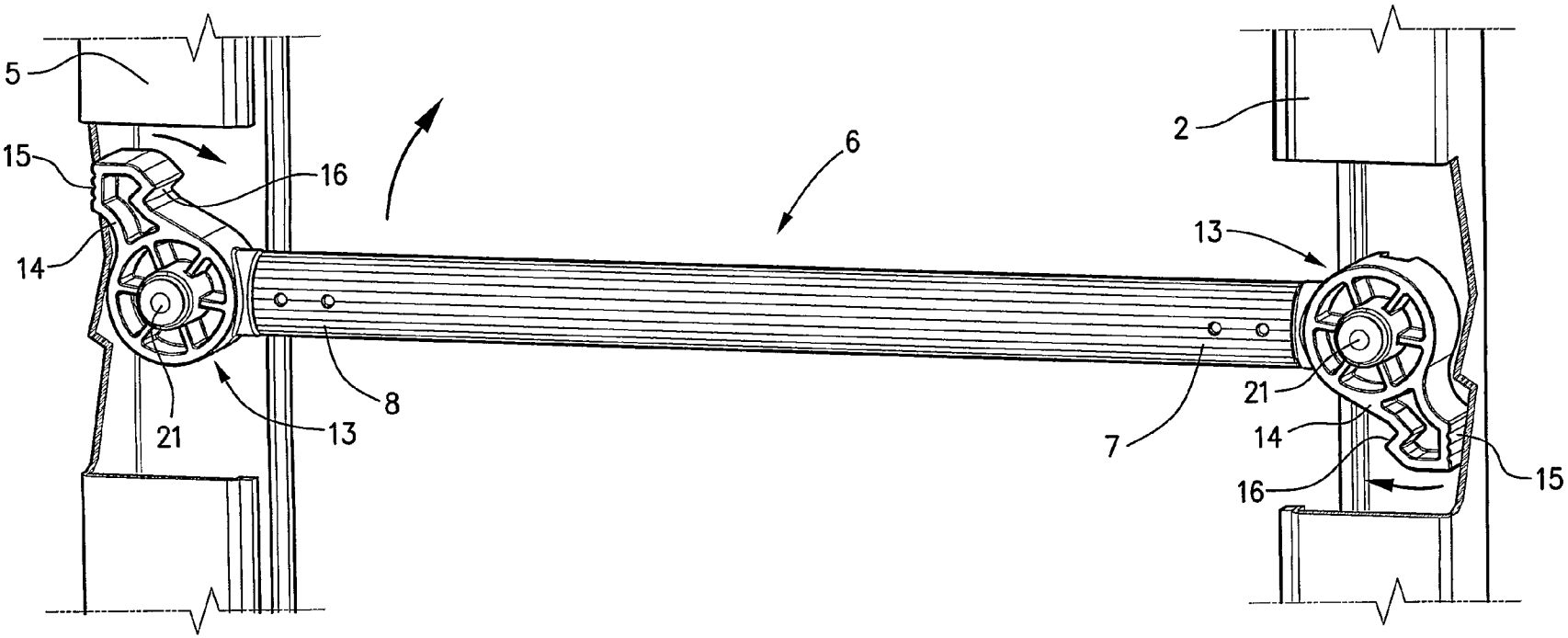
FIG. 7 shows the rung and buffer foot in detail
Figure 8:
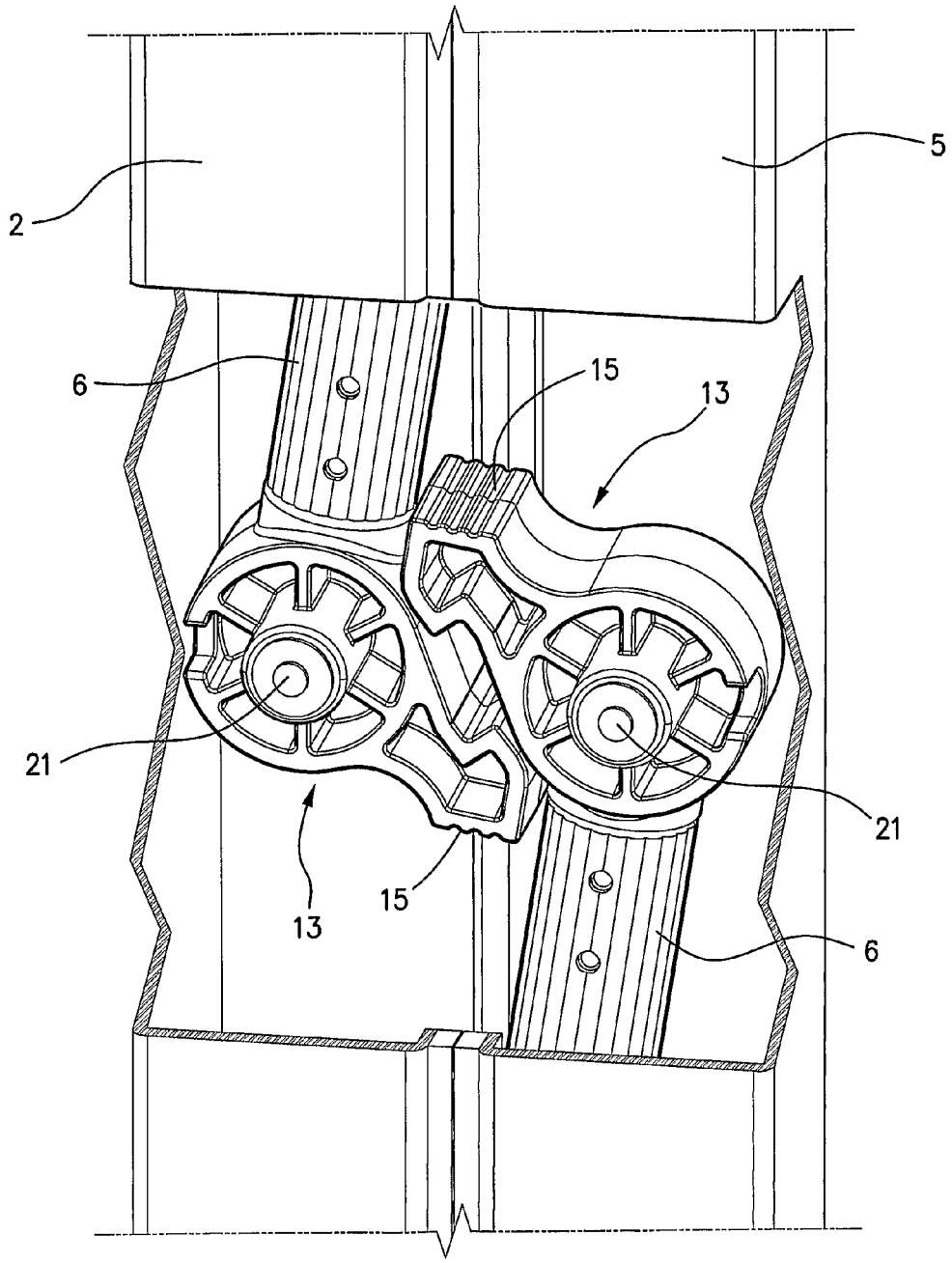
FIG. 8 shows the interaction of the rung hoods

The ladder rails and the specific mechanicals and cooperation between the rails and the fixed and movable risers is depicted in FIGS. 7 and 8 where the rails are made up of a elongate rail rung 6, which terminates at a first end 7 and a second end 8 with a rung head 13. The rung head is preferably fitted by riveting or sturdy attachment to each end of the rung 6, with the rung head taking the form of a generally circular fitting having a central pivot point 21. The rung head 13 includes a radially deployed lobe 14, with the lobe including a buffer foot 15 on one side thereof and a configured latch 16 on the other side, such that during movement of the ladder from the retracted to the open or deployed position, the rotation of the rungs via the pivots 21, causes the relative movement of the rung head 13 relative to the fixed and vertical risers such that the rotation of the lobe 14 is specifically configured such that the buffer foot 15 will abut and rest against the edges of both the fixed vertical riser 2 and movable vertical riser 5 as depicted in FIG. 7. In this manner the jarring or sudden deployment of the ladder from the retracted to the deployed state, is eased so as to minimise any potential damage to the ladder whilst allowing the ladder to be deployed quickly with the buffering occurring toward the lower end of the deployment action.

The rung head 13 functions in a dual capacity as a means to buffer the deployment of the ladder and contemporaneously the provision of the catch on the catch 16 on the inverse side of the lobe 14, is configured to cooperate to form a latching system in cooperation with a sprung keeper 18, positioned within the inside of the channel formation of the fixed vertical riser. The sprung keeper 18 is preferably formed of spring steel and can be formed around a keeper pivot lug 27 and will include a mating configuration to the catch 16 such that movement of the movable vertical riser from the deployed to the retracted position will cause the relative rotation of the rung head 13 which is drawn up closer to the keeper as the ladder is retracted and the catch 16 will be cause to engage sprung keeper 18 against its natural spring bias and the ladder can be clicked and latched into its retracted position.

Figure 9:
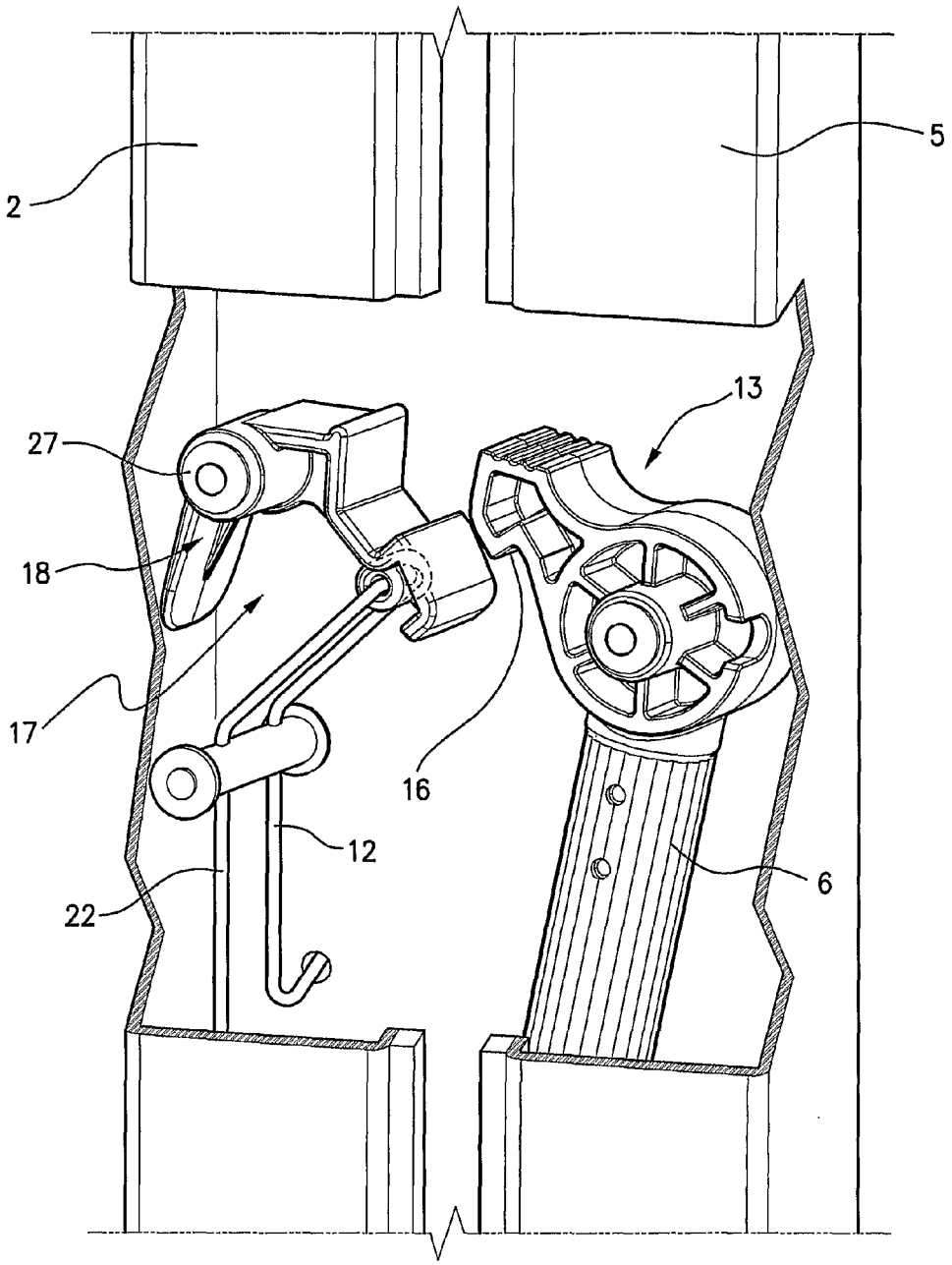
FIG. 9 shows a release cord and latch detail
Figure 10:
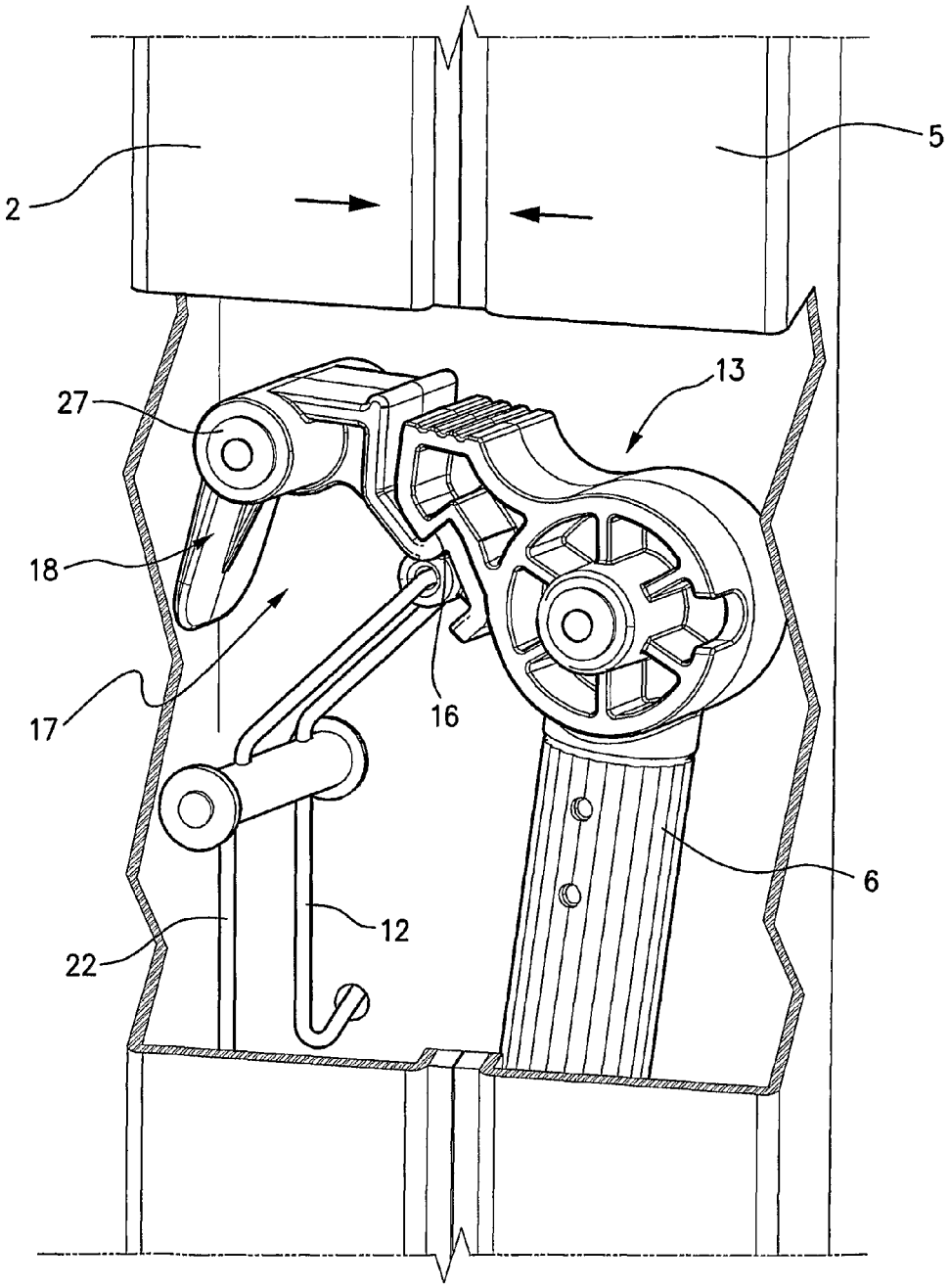
FIG. 10 shows the latch detail in the closed position
Figure 11:
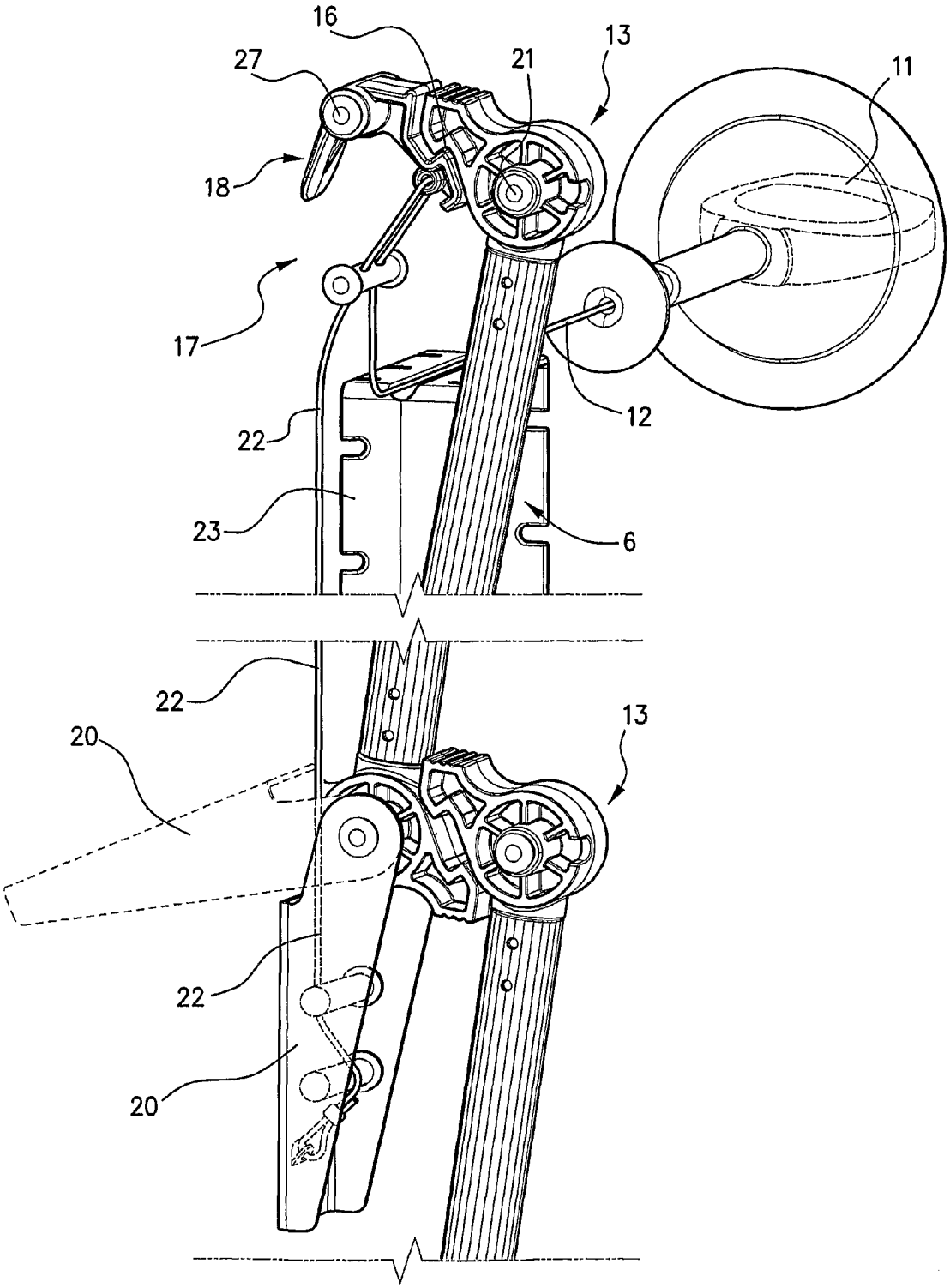
FIG. 11 shows the primary release cable and back-up

In order to deploy the ladder and release the latch system, a primary release cable 12 is provided as detailed in FIGS. 9 to 11, which takes the form of a flexible 10 cable connected to the sprung keeper 18 and conduited through the fixed vertical riser into the interior of the dwelling. In this manner the drawing of the cable 12 causes the keeper to be pulled against its bias closed position so as to release the catch 16 thereby allowing the ladder to be rapidly deployed.

In order to provide a means of deploying the ladder exterior to the dwelling, as may occur in the case of emergency where the occupant of the dwelling is incapacitated by smoke or other effects of a fire and the emergency ladder may provide a ready access to an observer from the outside who would not have access to the interior primary release cable, a secondary or back-up release cable 22 is provided to work in concert with the primary release cable 12 with the back-up release cable 22 being conduited down the length of the fixed vertical riser, so as to be operable by way of an override release lever 20, positioned toward the ground on the lower end of the fixed vertical riser as shown in FIG. 11. In this manner, the ladder can be deployed from the exterior of the building so as to provide an emergency exit or access to a building where the occupant is incapacitated.

In order to provide a security against unauthorised or inappropriate use, in addition to providing a general warning system, the ladder of the invention can be adapted to cooperate with an audio or visual alarm, such that once the ladder is deployed an audible or visual alarm is immediately raised to further assist in aiding the escape of an occupant from the dwelling. In addition, the alarm can be used as a way of indicating inappropriate use or deployment of the ladder in circumstances other than in an emergency.

In addition to the use of the ladder as a means of emergency escape from a building, the ladder may have an alternative function as an access ladder. In the embodiment of the invention as an access ladder there is a need for security to prevent unauthorised access. In this embodiment, the ladder can be provided with a lock to prevent the deployment thereof and with reference to FIG. 12, the lock can be seen to comprise a radial lock tab 19 formed in the periphery of the rung head, and a radial lock 24 positioned on the movable vertical riser to cooperate with the radial lock tab 19, so as to provide a way of preventing the rotation of the rung head and accordingly, prevent the rotation and deployment of the ladder.

Figure 12:
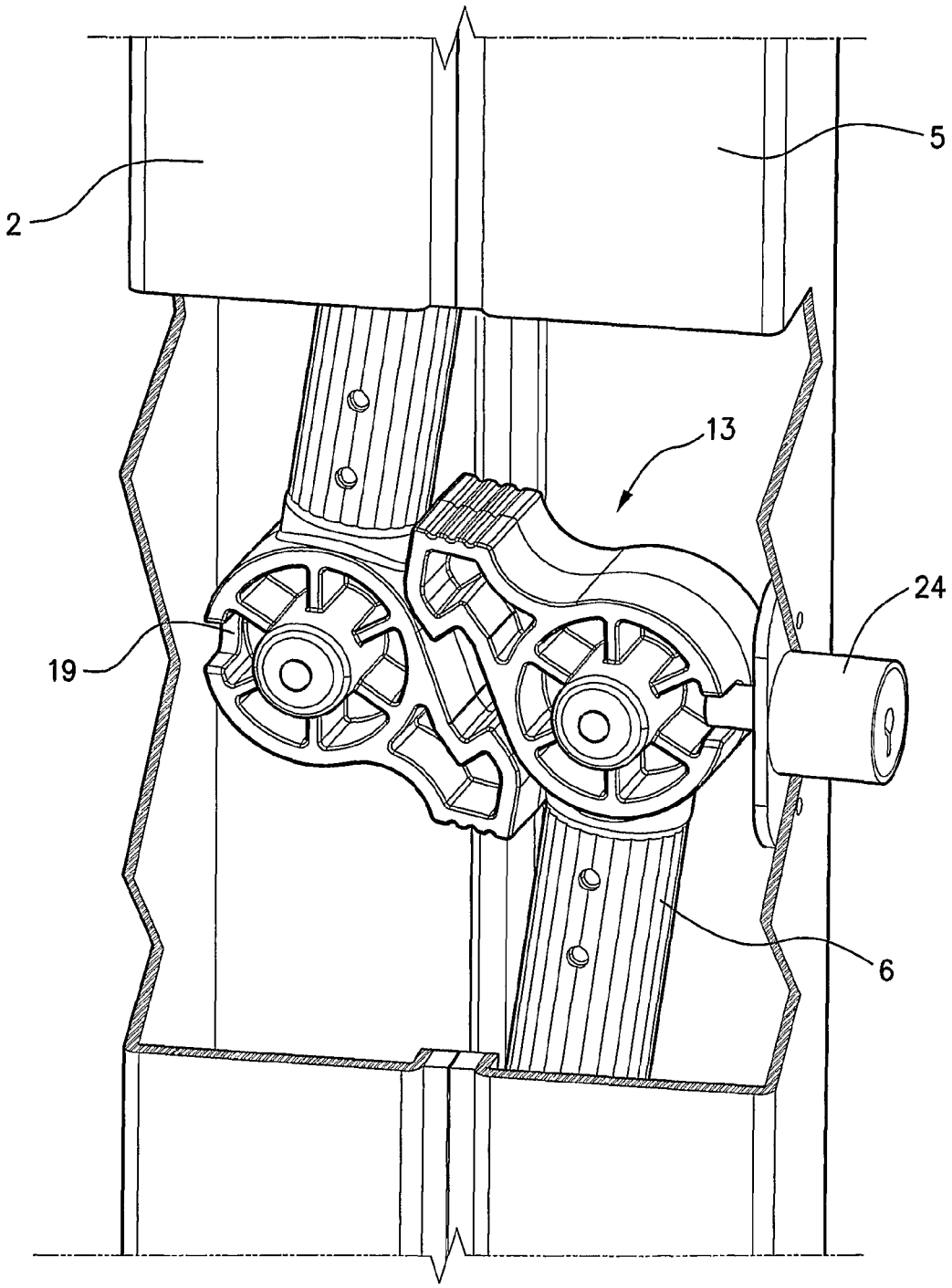
FIG. 12 shows the lock in the access ladder embodiment
Figure 13:
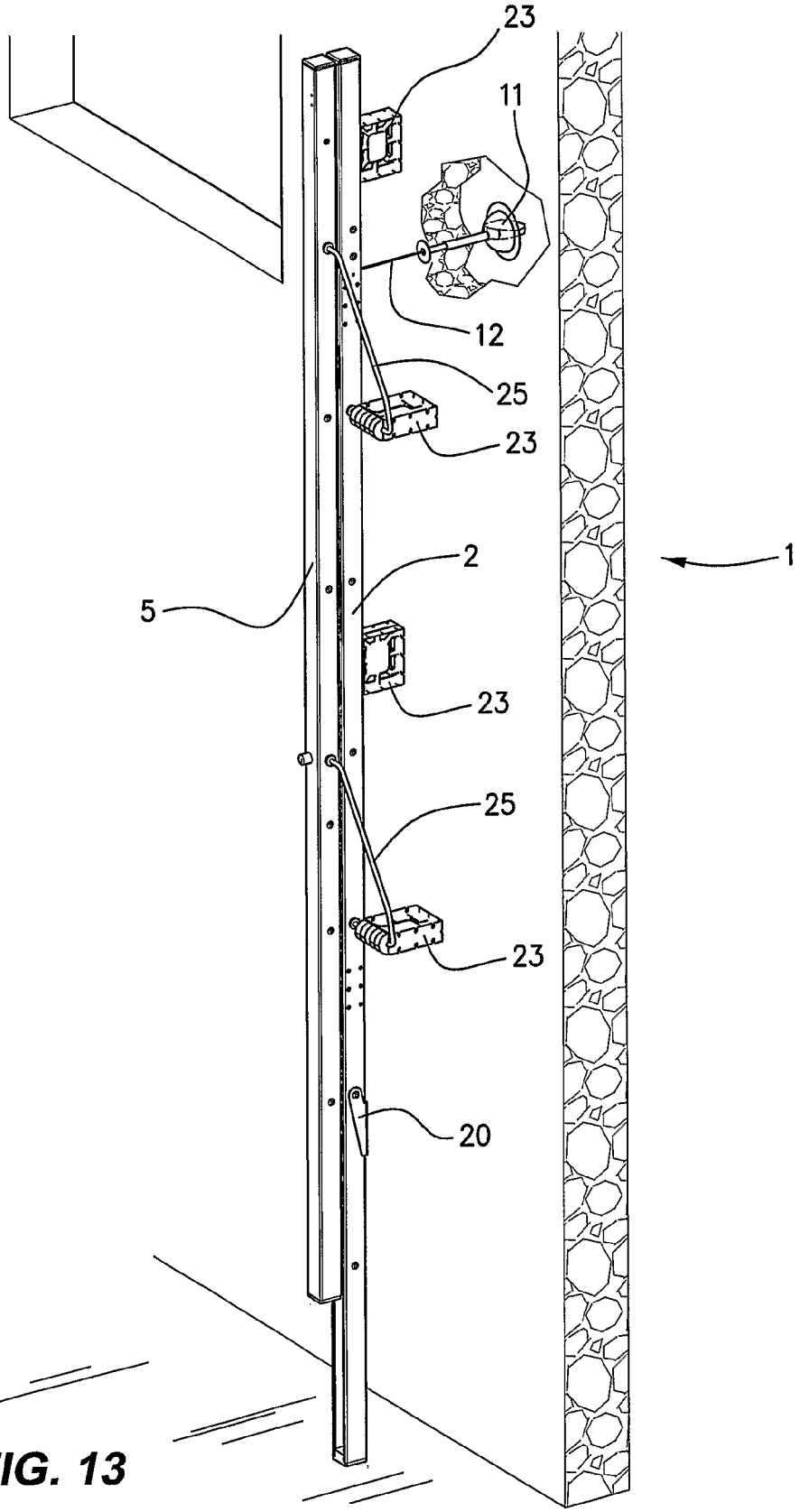
FIG. 13 shows a closed ladder mounted at 90° and spaced from a wall

Referring now to FIGS. 12 through to 17, an alternative embodiment of the invention is shown, with the emergency escape or access ladder being mounted for 90 degree alignment to a wall, where the deployed ladder sits out from the wall at 90 degrees thereto so as to provide an alternative exit configuration. In all respects, the 90 degree to the wall configuration of the ladder is analogous to the previously described embodiment, however in addition to the features previously described, the 90 degree embodiment includes a triangulated stabiliser 25, which is pivotally connected to the fixed vertical riser 2 and the movable vertical riser 5 so as to cooperate the pivotal connection thereof by the ladder rails, but such that the triangular configuration provides reinforcement and added security to the ladder which is not available from the mounting bracket used in a previously described embodiment.

In use, the folding emergency fire escape or access ladder of the invention will, for the majority of the time, be kept in its discrete retracted position where suitable paintwork and positioning adjacent a dwelling's window, can to all intents and purposes resemble water down-pipes or the like and as such, attract minimal attention and distraction from the aesthetics of a dwelling. When required for use, the escape ladder has been positioned relative to a second storey window of a dwelling such that for an occupant wishing to escape the ladder is readily released by the user grasping the release knob 11 and by drawing back the knob and connecting rod 12, the locking means is then activated so as to release the ladder from its first or retracted position, whereby acting under the bias, it automatically unfolds with the spigots 28 being drawn down to engage the notches 9 so as to provide a safe and secure ladder where the expanded functional state ensures that the ladder is locked into the expanded position so as to provide a ready means for occupant to safely escape a second storey window of the dwelling.

The discrete nature and folding provisions of the ladder of the invention allows it to be permanently positioned against the wall of a dwelling, thereby minimising any impact on the aesthetics and function of a dwelling, and also maximising user safety by keeping an escaping occupant against the exterior wall of a dwelling during the escape procedure.

Figure 14:
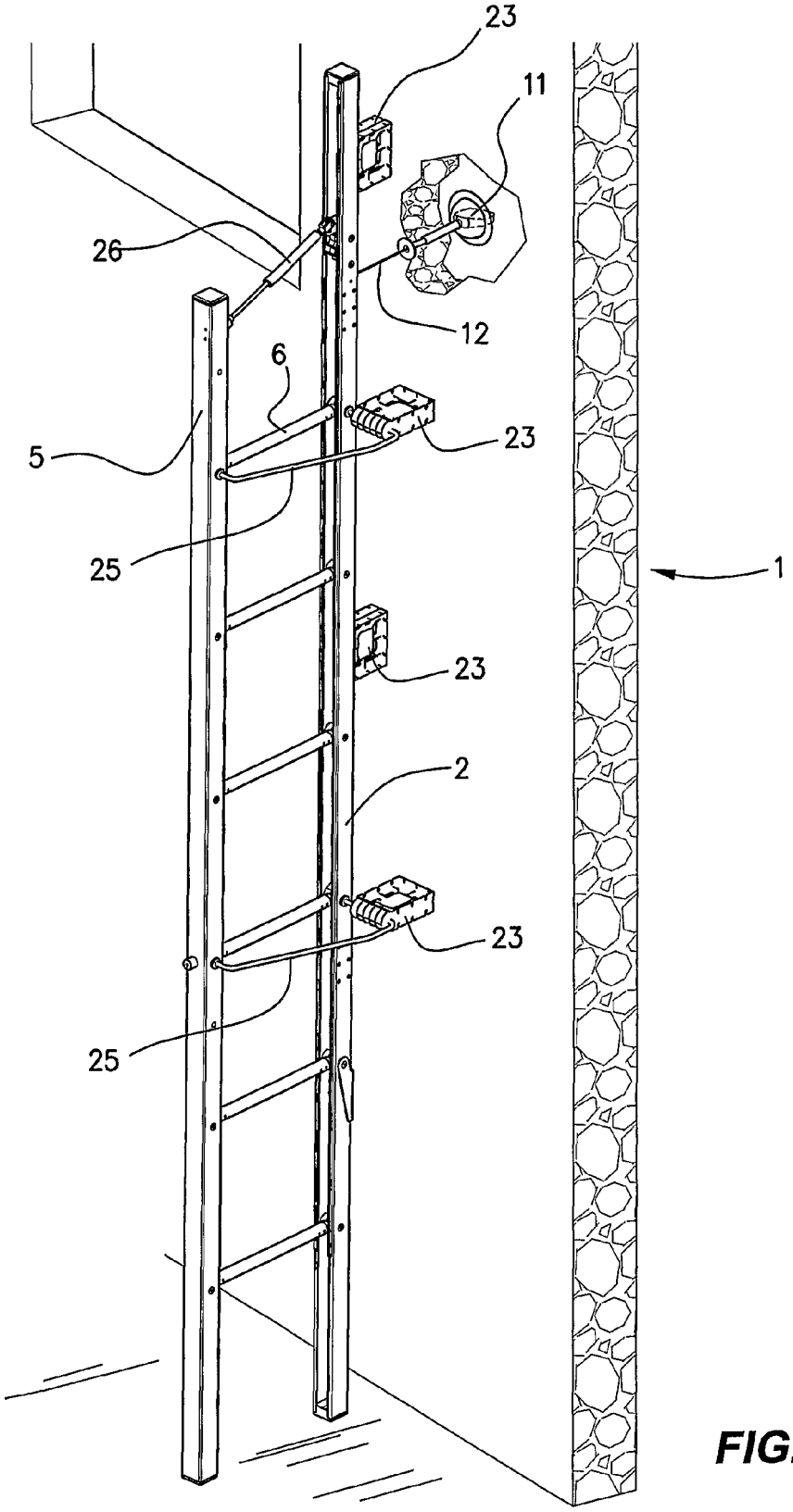
FIG. 14 shows an open ladder mounted at 90° and spaced from a wall
Figure 15:
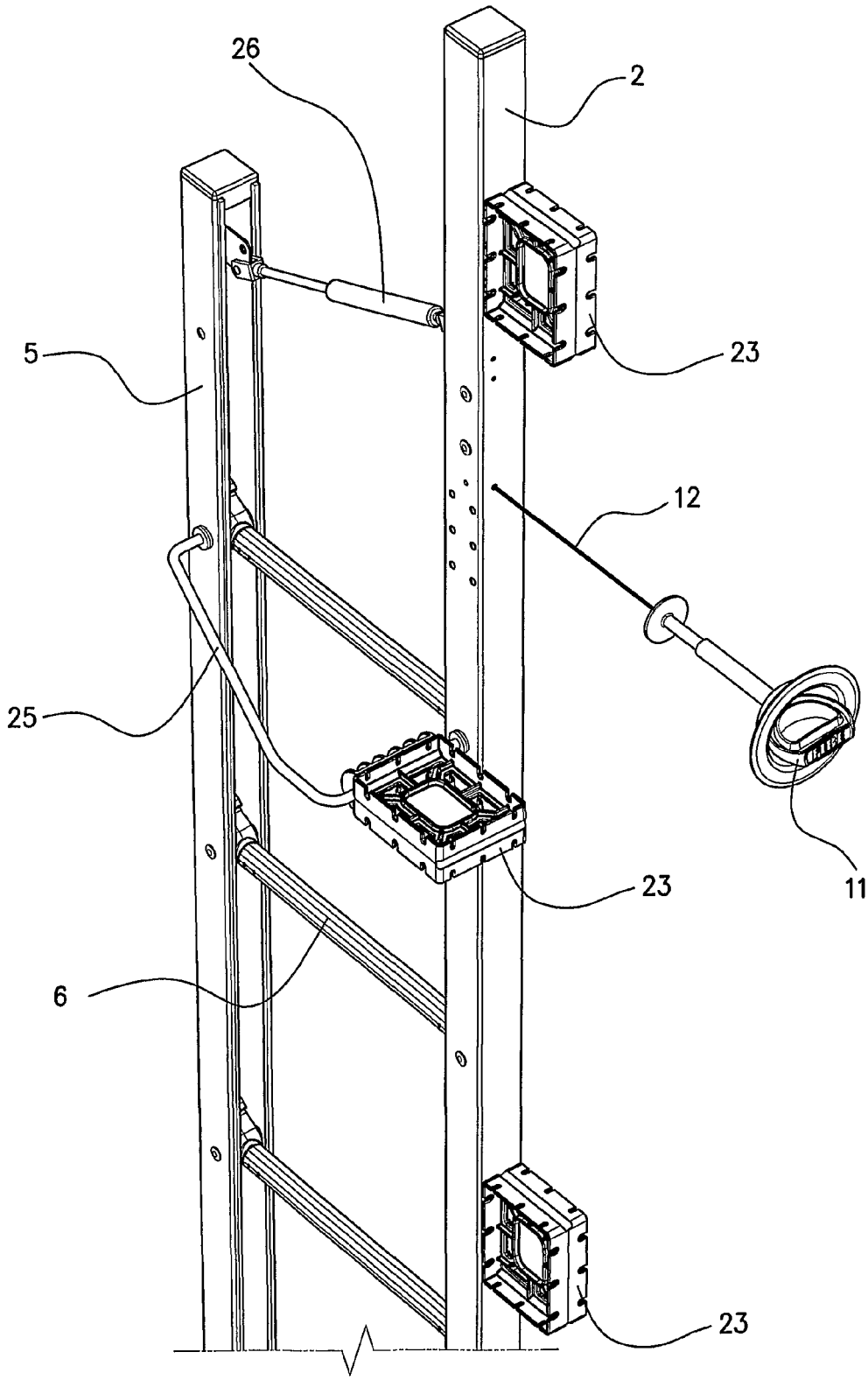
FIG. 15 shows an open ladder view from rear mounted at 90° and spaced from a wall
Figure 16:
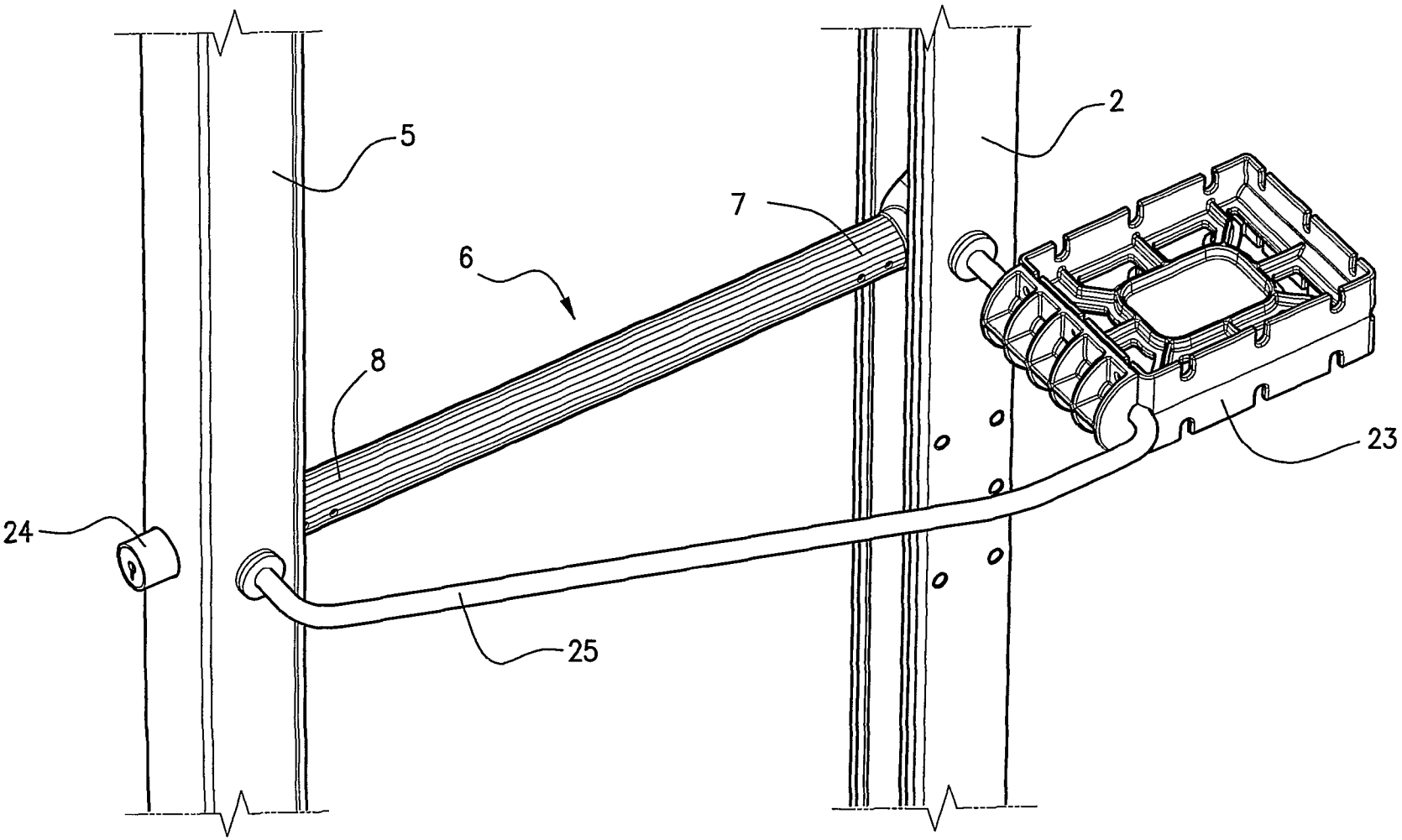
FIG. 16 shows a strut detail mounted at 90° and spaced from a wall
Figure 17:
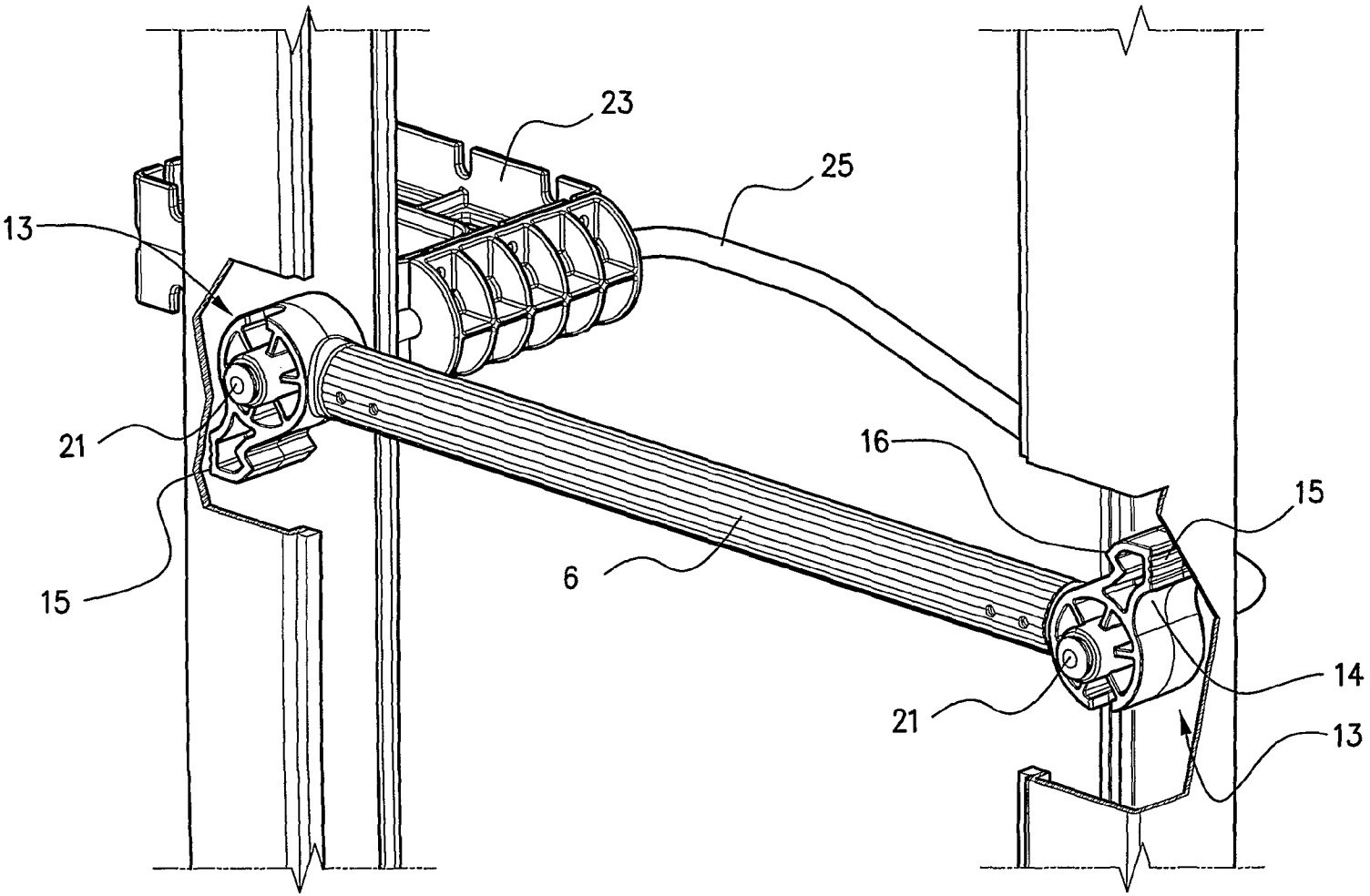
FIG. 17 shows buffer detail mounted at 90° and spaced from a wall

Whilst the ladder has been drawn in a central position under a window in FIGS. 1 to 4 and to the right of a window in FIG. 14, right-hand or left hand versions of the ladder are readily available in addition to central placement and provided by producing a suitably modified mechanism.

In another embodiment, the ladder of the invention can be configured for use as an access ladder rather than an emergency fire escape ladder. In this embodiment, the ladder is particularly adapted for deployment from the exterior of the building and in order to provide the necessary security to prevent unauthorised use of the ladder and subsequent unauthorised access to the building to which the ladder is fitted, the ladder includes a locking means as previously described. In use, the access embodiment of the ladder of the invention would again be kept in its discrete retracted position mounted to the dwelling or building's wall and when access is required via the ladder, the locking means 24 would be used to activate and disengage a locking bolt which would then release from the radial locking tab 19 and allow free deployment of the ladder.

It will be appreciated by persons skilled in the art that numerous variations and/or modifications may be made to the invention as shown in the specific embodiments without departing from the scope of the invention as broadly described. The present embodiments are, therefore, to be considered in all respects as illustrative and not restrictive.

The invention claimed is:

1. A folding emergency escape ladder for a dwelling comprising:

a fixed vertical riser adapted for fitting to an external wall of a dwelling, a plurality of retractable rails pivoted thereto from a first end and spaced at a distance apart suitable to function as rungs of said ladder and a movable vertical riser fitted in a corresponding manner from a second end of said rails such that said ladder is adapted to be moved between a retracted state with said rails folded up into and fully contained within said fixed vertical riser and said movable vertical riser in the retracted state, and an expanded, deployed state with said rails and risers functioning as a ladder mounted to said wall, wherein at least one of said rails include an elongate rail rung terminating at said first and second ends in a rung head, said rung head including an integral pivot and a projecting lobe elongated extending radially from said pivot, wherein said lobe includes a buffer foot formed on a first side of said lobe elongated, said buffer foot being adapted to abut a portion of one of said fixed and movable vertical risers coincident with said deployed state to buffer the deployment of said ladder and a latch formed on a second side of said lobe elongated opposite to said first side, said latch being adapted to cooperate with a keeper holding said rails and said movable vertical riser in said retracted state.

2. A ladder according to claim 1, wherein said keeper is fitted to said fixed riser and adapted to cooperate with the latch of the rung head fitted to said second end of at least one said rail.

3. A ladder according to claim 2, wherein said keeper is movable between a first engaging position and a second releasing position and is biased to said first engaging position to receive and engage said latch and movable against said bias to said second position to release said latch.

4. A ladder according to claim 3, including a release adapted to cooperate with said keeper wherein said release includes a primary release cable fitted to said keeper and adapted to move said keeper against said bias thereof from said first engaging position to said second release position and wherein said primary release cable is operated from an interior of said dwelling.

5. A ladder according to claim 4, further including a secondary release cable fitted to said keeper and adapted to move said keeper against its bias from said first engaging position to said second release position and wherein said secondary release is operated from the exterior of said dwelling.

6. A ladder according to claim 1, further including an arrangement to activate an alarm responsive to the deploying of said ladder.

7. A ladder according to claim 1, wherein said fixed and movable vertical risers are positioned against said external wall so as to provide an escape ladder mounted against said wall.

8. A ladder according to claim 1, wherein said fixed vertical riser is positioned against said wall and said movable vertical riser is positioned for movement away from said wall and wherein said ladder includes at least one triangulated stabilizer pivotally fitted between said fixed and movable riser to correspond with the pivotal action of said retractable rails.

9. A ladder according to claim 8, wherein said stabilizers are adapted for mounting to said wall to extend a pivot base of said fixed riser.

10. A ladder according to claim 1, wherein said rung head is a circular fitting having a central pivot point comprising said integral pivot and wherein said lobe is radially deployed with respect to the central pivot point.

* * * * *